US005234488A

United States Patent [19]

Ichikawa et al.

[11] Patent Number: 5,234,488

[45] Date of Patent: Aug. 10, 1993

[54] MOLD ADDITIVE FOR CONTINUOUS CASTING OF STEEL

[75] Inventors: Kenji Ichikawa; Osamu Nomura; Akihiro Morita, all of Bizen; Yoichiro Kawabe, Wake; Hideaki Fujiwara, Tsukubo; Koyo Yanagawa, Bizen, all of Japan

[73] Assignee: Shinagawa Refractories Co., Ltd., Tokyo, Japan

[21] Appl. No.: 563,802

[22] Filed: Aug. 6, 1990

Related U.S. Application Data

[63] Continuation of Ser. No. 258,860, Oct. 17, 1988, abandoned.

[30] Foreign Application Priority Data

Oct. 19, 1987 [JP] Japan ..... 261879

[51] Int. Cl.[5] ..... B22D 11/10; C21C 7/076

[52] U.S. Cl. ..... 75/305; 75/309; 164/473

[58] Field of Search ..... 164/473; 75/305, 307, 75/309

[56] References Cited

U.S. PATENT DOCUMENTS

| | | | |
|---|---|---|---|
| 4,168,966 | 9/1979 | Furui et al. | 75/257 X |
| 4,290,809 | 9/1981 | Loane, Jr. | 164/473 X |
| 4,340,426 | 7/1982 | Tabei et al. . | |

FOREIGN PATENT DOCUMENTS

| | | | |
|---|---|---|---|
| 320184 | 1/1975 | Austria . | |
| 0245107 | 11/1987 | European Pat. Off. . | |
| 59-61557 | 4/1984 | Japan | 164/473 |
| 60-40652 | 3/1985 | Japan | 164/473 |
| 60-180655 | 9/1985 | Japan | 164/473 |
| 60-191645 | 9/1985 | Japan | 164/473 |
| 61-14055 | 1/1986 | Japan | 164/473 |
| 792023 | 3/1958 | United Kingdom . | |
| 1230094 | 4/1971 | United Kingdom . | |
| 1243837 | 8/1971 | United Kingdom . | |
| 1301172 | 12/1972 | United Kingdom . | |
| 1385810 | 2/1975 | United Kingdom . | |
| 1465635 | 2/1977 | United Kingdom . | |

*Primary Examiner*—J. Reed Batten, Jr.
*Attorney, Agent, or Firm*—Wenderoth, Lind & Ponack

[57] ABSTRACT

A mold additive suitable for use in a mold for continuous casting of steel which comprises, as its base material, at least 50% by weight of synthetic calcium silicate which contains CaO and $SiO_2$ in a total amount not less than 70% by weight, and whose $CaO/SiO_2$ ratio is not lower than 1.20. A mold additive of low bulk density and superior in heat insulation can be obtained and its $CaO/SiO_2$ ratio can be widely adjusted.

1 Claim, No Drawings

MOLD ADDITIVE FOR CONTINUOUS CASTING OF STEEL

This application is a continuation of now abandoned application, Ser. No. 07/258,860 filed on Oct. 17, 1988, abandoned.

BACKGROUND OF THE INVENTION

The present invention relates to a mold additive suitable for use in a mold for continuous casting of steel and, more particularly, to a mold additive that contains synthetic calcium silicate as a base material and is suitable for use in a mold for continuous casting of steel.

Such a mold additive for use in a mold for continuous casting of steel is composed of a primary material such as portland cement, yellow phosphorus slag, or wollastonite and, as required, an $SiO_2$-containing material. The mold additive further includes a flux material such as soda ash, borax, cryolite, sodium fluoride or fluorite, and a carbonaceous material which serves as a melting-rate adjusting agent.

The mold additive is applied to the surface of a molten steel which has been poured into a mold, in which the mold additive is consumed while performing various functions. The important functions of the mold additive are (1) lubrication between the mold and a solidifying shell, (2) melting and absorption of any inclusion which rises to the surface of the molten steel, and (3) heat insulation with respect to the molten steel.

The progressive development of continuous casting processes in Japan is outstanding, and active efforts are being directed to increasing the proportion of HCR (hot charge rolling) or HDR (hot direct rolling) in a complete continuous casting process, the speeding up of casting, and so forth. In this situation, it is strongly desired to employ even stricter criterion for the mold additives which influence the quality of cast pieces and the stability of a casting process and, in addition, there is a demand for the supply of mold additives of various kinds which have characteristics that greatly differ from those of conventional mold additives. For these reasons, it has been proposed to provide a wide variety of chemical compositions which govern various characteristics of these mold additives, such as softening point, melting point, viscosity, surface tension and crystallization temperature. In particular, it is of great importance to adjust the weight ratio of CaO to $SiO_2$ (hereinafter referred to as the "$CaO/SiO_2$ ratio") as this ratio has a critical influence on these characteristics.

To achieve the functions (1) and (2) among the above noted functions of such a powder, it is most important to adjust the characteristics such as a softening point and viscosity of the mold additive which invites the importance of selection of chemical composition mentioned above. To achieve the function (3) regarding the heat insulation with respect to a molten steel, it is important to suitably select such powder characteristics as bulk density and spreadability, as well as the powder's melting rate which can be adjusted by a carbonaceous material.

The base material of the conventional mold additive is selected from among portland cement, yellow phosphorus slag, synthetic slag, wollastonite and the like. Each of these materials, however, has its merits and demerits, and there is no material having the characteristics to meet all the requirements of a base material.

For example, portland cement is characterized by its relatively stable chemical composition. Further, since its $CaO/SiO_2$ ratio is higher than those of the other base materials, by combining the portland cement and a pearlite powder such as a light $SiO_2$-containing material, it is possible to achieve low bulk density and good heat insulation and to adjust the $CaO/SiO_2$ ratio over a wide range. However, portland cement contains $4CaO.Al_2O_3.Fe_2O_3$ in a range of 9 to 15% by weight and hence the resulting mold additive usually contains $Fe_2O_3$ in an amount of about 2% by weight. The $Fe_2O_3$ in the powder may react with a component (for example, Al) of a molten steel to cause contamination of the molten steel and this will at the same time result in a change in the characteristics of the mold additive. Accordingly, it is impossible to achieve stable lubrication. In addition, since a powder which includes portland cement as its base material is susceptible to hydration, it is difficult to subject such a powder to granulation using a generally adopted granulation process which comprises the steps of watering, kneading and extruding.

In contrast, yellow phosphorus slag, as well as synthetic slag having a composition analogous to that of the same, is a molten-quenched in water and crushed substance. Accordingly, such slag can be used as an amorphous material which excels in homogeneity of component distribution, and granulation thereof is easy. However, since the $CaO/SiO_2$ ratio is relatively low (0.9–1.15), if a mold additive having a relatively high $CaO/SiO_2$ ratio is to be manufactured, the amount of light $SiO_2$-containing material added needs to be reduced, thus resulting in the problem that the bulk density of the obtained powder is high. Another disadvantage of this material is that a powder composition having a $CaO/SiO_2$ ratio of 1.15 or more cannot be obtained.

Wollastonite has an even lower $CaO/SiO_2$ ratio and its use is therefore limited to an extremely narrow range of applications. In addition, wollastonite is inferior in terms of the stability of its components.

Various other methods have been proposed, for example, a method of producing a powder having a high $CaO/SiO_2$ ratio by adding limestone or fluorite to a base material such as yellow phosphorus slag or wollastonite having a relatively low $CaO/SiO_2$ ratio. However, all of the conventional methods involve problems with respect to the stability of the product quality. Accordingly, it has been impossible to provide a powder of desired quality.

SUMMARY OF THE INVENTION

The present inventors investigated various kinds of material in order to solve the above-described problems experienced in the conventional types of powder base material and discovered that as for a base material for a mold additive of the present invention, a synthetic calcium silicate having CaO and $SiO_2$ in a total amount not less than 70% by weight, $Al_2O_3$ in an amount not more than 8% by weight, $Fe_2O_3$ in an amount not more than 1% by weight, and F in an amount of 1 to 10% by weight, and whose $CaO/SiO_2$ ratio is not lower than 1.20 is suitable for achievement of the object of the present invention.

It is, therefore, an object of the present invention to provide a mold additive suitable for use in a mold for continuous casting of steel, which mold additive includes, as its base material, at least 50% by weight of synthetic calcium silicate which contains CaO and $SiO_2$ in a total amount not less than 70% by weight, $Al_2O_3$ in an amount not more than 8% by weight, $Fe_2O_3$ in an amount not more than 1% by weight, and F in an amount of 1 to 10% by weight, and whose $CaO/SiO_2$ ratio is not lower than 1.20.

DESCRIPTION OF THE INVENTION

Synthetic calcium silicate which is used as the base material of a mold additive according to the present invention has a relatively high $CaO/SiO_2$ ratio. Accordingly, if the mold additive is to be manufactured, a large amount of light $SiO_2$-containing material can be employed. Therefore, it is possible to provide a mold additive having low bulk density and good heat insulation properties and also to select the $CaO/SiO_2$ ratio over a wide range by changing the amount of $SiO_2$-containing material to be added. In addition, since the $Fe_2O_3$ content of synthetic calcium silicate is small, the amount of Al203 generated due to the reaction of $Fe_2O_3$ with Al in a molten steel is small, so that it is possible to prevent contamination of the steel. Furthermore, the extent of change in powder characteristics due to the generation of $Al_2O_3$ is small and thus stable lubrication is enabled. Accordingly, the synthetic calcium silicate of the present invention possesses characteristics suitable for use as the base material of the mold additive for which an especially strict criterion must be employed.

Synthetic calcium silicate used in the present invention is easily obtained in the following manner. Materials such as $CaCO_3$, $Ca(OH)_2$, dolomite, siliceous sand, quartzite, bauxite, clay, chamotte, cullet, soda ash, lithium carbonate, cryolite, sodium fluoride, fluorite and coke powder are mixed so as to form a predetermined chemical composition, melted at a high temperature not lower than 1,400° C. in a heating furnace such as an electric furnace, quenched in water and granulated, dried at 100° C. or higher, and ground to under 100 mesh by a conventional pulverizing mill such as a ball mill.

The coke powder is added to reduce and eliminate $Fe_2O_3$ in a melt, while the glass powder is added to shorten a melting time period.

Since the synthetic calcium silicate thus obtained is an amorphous molten-quenched in water and crushed material, its components are distributed homogeneously and neither free CaO nor hydratable minerals such as $3CaO.SiO_2$ are contained. Accordingly, the present synthetic calcium silicate can be granulated by a granulation process which comprises the steps of watering, kneading and extruding or by spray-drying the same in a slurry-like form.

Next, the composition of the synthetic calcium silicate base material will be described. Its $CaO/SiO_2$ ratio is selected to be not lower than 1.20. This is because, if the $CaO/SiO_2$ ratio is not lower than 1.20, the range of selection of the $CaO/SiO_2$ composition of a mold additive can be widened and because, if a large amount of light $SiO_2$ is used, a powder having low bulk specific gravity and good heat insulation properties can be obtained. From these viewpoints, it is preferable that the $CaO/SiO_2$ ratio of synthetic calcium silicate is as high as possible. However, as the $CaO/SiO_2$ ratio is increased, the solidifying point and crystallization temperature of a melt become higher and thus the manufacture of melts becomes remarkably difficult, with the result that the desired amorphous material is difficult to obtain in a stable state. Accordingly, the $CaO/SiO_2$ ratio of synthetic calcium silicate used in the present invention is preferably 1.2 to 2.3, more preferably 1.2 to 1.9.

The powder occasionally absorbs a large amount of $Al_2O_3$ which rises to the surface of a molten steel in the mold. If powder slag contains $Al_2O_3$ in an amount not less than 15% by weight, a high-melting-point mineral such as gehlenite ($2CaO.Al_2O_3.SiO_2$) is precipitated and the effect of lubrication deteriorates. Accordingly, the $Al_2O_3$ content of the synthetic calcium silicate used in the present invention is preferably not more than 8% by weight, more preferably not more than 5% by weight.

$Fe_2O_3$ reacts with components contained in a molten steel to cause contamination of the steel and also to cause changes in the characteristics of the powder slag. Accordingly, it is necessary to limit the $Fe_2O_3$ content of the synthetic calcium silicate to not more than 1% by weight, more preferably not more than 0.3% by weight.

F is added for the purpose of adjusting the viscosity of a melt in the manufacture thereof and improving the efficiency of working operation. If an excessive amount of F is added, a melting furnace is damaged severely and also changes in composition due to evaporation is found. If the amount of F added is excessively small, the effect of viscosity drop will be small. Accordingly, the F content of the present synthetic calcium silicate is preferably 1 to 10% by weight, more preferably 2 to 7% by weight.

Further, flux components such as $Na_2O$, $Li_2O$ and $B_2O_3$ are added for purposes similar to those of F, so that it is possible to adjust the melting point and viscosity of a melt during manufacture of synthetic calcium silicate. However, in view of damage to a melt container or the amount of evaporation during manufacture, it is preferable that the total amount of the flux components added is not more than 15% by weight.

The powder of the present invention is composed of a base material, a $SiO_2$-containing material, a flux material and a carbonaceous material all of which will be listed below:

base material: synthetic calcium silicate
$SiO_2$-containing material: pearlite, fly ash, siliceous sand, glass powder, diatomaceous earth or the like,
flux material: soda ash, $Li_2CO_3$, NaF, $Na_3AlF_6$, fluorite, $BaCO_3$, $M_gCO_3$, $M_gF_2$, borax or the like, and
carbonaceous material: coke powder, carbon black, natural graphite or the like.

It is necessary to adjust the melting characteristics of the mold additive, such as softening point, melting point, viscosity, surface tension, crystallization temperature, and melting rate in accordance with casting conditions such as casting temperature, mold size, the grade of steel and casting speed. Such melting characteristics are governed by the chemical composition of the mold additive, and the above-described materials need to be mixed so that each of the materials may assume a predetermined chemical composition.

In accordance with the present invention, the chemical composition of the mold additive (or powder) for use in a continuous casting of steel is as follows:

$CaO=20$ to 45% by weight,
$SiO_2=25$ to 50% by weight,
the weight ratio of $CaO/SiO_2=0.7$ to 1.5,
$Al_2O_3=0$ to 10% by weight,
$Fe_2O_3=0.1$ to 2.0% by weight,
$MgO=0$ to 10% by weight,
$Na_2O+K_2O+Li_2O=1$ to 25% by weight,
$F=2$ to 15% by weight,
$B_2O_3=0$ to 10% by weight, MnO=0 to 5% by weight,
BaO=0 to 15% by weight, and
C=0.5 to 10% by weight.

The mold additive having the above chemical composition according to the present invention is obtained by mixing at least 50% by weight of synthetic calcium silicate base material, 2 to 30% by weight of $SiO_2$ material, 3 to 30% by weight of flux material and 0.5 to 8% by weight of carbonaceous material.

It is undesirable for the amount of synthetic calcium silicate added to be less than 50% by weight, since the homogeneous distribution and stability of components which are characteristic of synthetic calcium silicate is lowered.

The $SiO_2$-containing material is used for the purpose of adjusting the bulk density and $CaO/SiO_2$ ratio of the powder. It is undesirable for the amount of $SiO_2$-containing material added to be less than 2% by weight, since the bulk density cannot be sufficiently lowered even with the use of a light $SiO_2$-containing material such as pearlite and, in addition, heat insulation properties would deteriorate. Also, it is undesirable for the amount of $SiO_2$-containing material added to exceed 30% by weight, since the bulk density becomes too small and the amount of powder dust generation increases.

To adjust the melting characteristics, it is necessary to add the flux material in an amount not less than 3% by weight. However, if an excessive amount of flux material is added, its composition may change due to evaporation during melting and, in addition, the immersion nozzle used in pouring a molten steel into a mold may be seriously damaged. Accordingly, it is preferable that the maximum amount of flux material added is 30% by weight.

The carbonaceous material is added in order to adjust the melting rate of the powder. If the amount of addition is less than 0.5% by weight, no substantial effect can be obtained. On the other hand, it is undesirable that the amount of addition exceeding 8% by weight, since the melting rate decreases to an excessive degree.

The mold additive according to the present invention is obtained by preparing each of the materials in accordance with the above-described chemical composition and mixing the prepared materials in a V-type mixer or a nauter mixer. In addition, it is possible to obtain granules of columnar shape by kneading the material mixture with water and granulating it by an extrusion granulator. It is also possible to obtain a mold additive whose grains have a spherical shape by converting the material mixture into a slurry-like form and effecting spray-drying thereof.

EXAMPLE

Preparation of Synthetic Calcium Silicate Base Material

A mixture of the materials which had the composition shown in the following Table 1 was melted by heating at a temperature of 1,650° to 1,700° C. in an electric furnace, and the obtained melt was quenched in water and crushed. The granules were dried at 190° C. and finally ground to under 100 mesh by a ball mill, thus preparing base materials composed of synthetic calcium silicate 1, 2 and 3.

TABLE 1

| | Synthetic calcium silicate (% by weight) | | |
|---|---|---|---|
| | 1 | 2 | 3 |
| limestone | 50.5 | 52.0 | 56.5 |
| cullet | 7.5 | 6.0 | 6.5 |
| chamotte | 10.5 | 5.0 | — |
| quartzite | 16.0 | 18.0 | 17.0 |
| dolomite | 7.5 | 9.5 | 14.0 |
| fluorite | 6.5 | 8.0 | 4.0 |
| soda ash | 1.5 | 1.5 | 2.0 |
| coke powder (external percentage) | 3.0 | 3.0 | 3.0 |

Table 2 shows the compositions of the obtained synthetic calcium silicate 1, 2 and 3. Table 2 further shows the compositions of yellow phosphorus slag, synthetic slag and portland cement used in preparing comparative powder samples.

TABLE 2

| | (% by weight) | | | | | | | |
|---|---|---|---|---|---|---|---|---|
| | $SiO_2$ | $Al_2O_3$ | $Fe_2O_3$ | CaO | MgO | $Na_2O$ | F | Weight ratio of $CaO/SiO_2$ |
| Synthetic calcium silicate 1 | 38.7 | 5.9 | 0.3 | 48.7 | 2.2 | 1.5 | 3.5 | 1.26 |
| Synthetic calcium silicate 2 | 36.0 | 2.7 | 0.3 | 52.2 | 3.4 | 1.7 | 4.8 | 1.45 |
| Synthetic calcium silicate 3 | 31.1 | 1.4 | 0.2 | 56.6 | 4.5 | 2.5 | 2.6 | 1.82 |
| Portland cement | 22.0 | 6.7 | 4.1 | 64.2 | 1.4 | | | 2.92 |
| Yellow phosphorus slag | 44.0 | 3.0 | 0.2 | 48.5 | 0.3 | 0.4 | 2.5 | 1.10 |
| Synthetic slag | 43.5 | 3.0 | 0.3 | 48.5 | 0.8 | 1.0 | 2.6 | 1.11 |

Base materials composed of synthetic calcium silicate 1, 2 and 3 were each mixed with the mixtures of the materials which had the composition shown in the following Table 3 by means of a V-type mixer, thus preparing mold additive samples of the present invention and comparative mold additive samples.

The results when applied for actual casting processes as well as the compositions and typical characteristics of the respective powder samples are shown in Table 3.

TABLE 3

| | Samples according to this invention | | | | | Comparative samples | | |
|---|---|---|---|---|---|---|---|---|
| | 1 | 2 | 3 | 4 | 5 | 6 | 7 | 8 |
| Mixing ratio (% by weight) | | | | | | | | |
| Synthetic calcium silicate 1 | | | | 84 | | | | |
| Synthetic calcium silicate 2 | 57 | | | | 58 | | | |
| Synthetic calcium silicate 3 | | 66 | 70 | | | | | |
| Yellow phosphorus slag | | | | | | | | 70 |
| Synthetic slag | | | | | | | 80 | |
| Portland cement | | | | | | 44 | | |
| $SiO_2$ - containing material | 25 | 17 | 13 | 5 | 25 | 39 | | |
| Fluorite | | | | | | | | 8 |
| Flux material | 14 | 13 | 13 | 10 | 10 | 13 | 16 | 18 |
| Carboneceous material | 4 | 4 | 4 | 1 | 7 | 4 | 4 | 4 |
| Chemical composition (% by weight) | | | | | | | | |
| $SiO_2$ | 39.2 | 33.5 | 31.9 | 36.3 | 39.7 | 38.3 | 34.8 | 31.0 |
| $Al_2O_3$ | 3.4 | 2.7 | 2.7 | 5.6 | 4.9 | 6.1 | 2.4 | 2.1 |
| $Fe_2O_3$ | 0.2 | 0.2 | 0.2 | | | 2.0 | 0.2 | 0.2 |
| CaO | 31.0 | 37.9 | 39.8 | 40.9 | 30.5 | 30.1 | 38.8 | 39.1 |
| MgO | 2.3 | 3.1 | 3.2 | 1.9 | 2.0 | 1.1 | 0.6 | 0.2 |
| $Na_2O$ | 12.5 | 11.9 | 11.5 | 8.9 | 9.6 | 12.6 | 12.0 | 11.7 |
| F | 7.7 | 7.6 | 7.7 | 7.5 | 7.3 | 5.9 | 7.6 | 7.8 |
| Free carbon | 3.8 | 3.8 | 3.8 | 0.94 | 6.6 | 3.8 | 3.8 | 3.8 |
| Weight ratio of $CaO/SiO_2$ | 0.79 | 1.13 | 1.25 | 1.13 | 0.77 | 0.79 | 1.11 | 1.26 |
| Characteristics | | | | | | | | |
| Softening point (°C.) | 1060 | 1110 | 1135 | 1130 | 1070 | 1030 | 1110 | 1140 |
| Viscosity (poise, 1300° C.) | 3.6 | 2.4 | 1.2 | 2.9 | 4.0 | 3.5 | 2.3 | 1.1 |
| Bulk density | 0.75 | 0.78 | 0.77 | 0.79 | 0.73 | 0.72 | 0.97 | 1.01 |
| Test results | | | | | | | | |
| Heat insulation property | Good | Good | Good | Good | Good | Good | Bad | Bad |
| Surface defect | | | Rarely observed | | | | Frequently observed | |
| Lubrication stability | ○ | ○ | ○ | ○ | ○ | x | ○ | Δ |
| Quality stability | ○ | ○ | ○ | ○ | ○ | Δ | ○ | x |

NOTE) In Table 3, $SiO_2$-containing material: total of the weight percents of pearlite powder and glass powder, flux material: total of the weight percents of soda ash and sodium fluoride, softening point: measured by a Seger-cone method at a temperature rise of 5° C./min., viscosity: measured by a platinum-ball lifting method, bulk density: a 1-l container, charging naturally, heat insulation property: by the observation of the condition in a mold, surface defect: slag spot, pinhole, longitudinal crack, etc., lubrication stability: results of mold copper temperature measurements, and quality stability: frequency of the occurrence of break-outs and surface defects.

The symbols used to describe the Lubrication stability and Quality stability in Table 3 have the following meanings:

○: good;

Δ: fair;

×: bad.

The synthetic calcium silicate base material which is used for the mold additive for a continuous casting of the present inventive powder possesses the merits of both portland cement and yellow phosphorus slag. Accordingly, the mold additive of the present invention which contains at least 50% by weight of synthetic calcium silicate provides the following features.

1) Since the light $SiO_2$-containing material is added, low bulk density and good heat insulation properties can be achieved.

2) If the amount of $SiO_2$ material to be added is adjusted, it is possible to manufacture various powders whose compositions range from a low $CaO/SiO_2$ ratio to a high $CaO/SiO_2$ ratio.

3) Since the $Fe_2O_3$ content is small, stable lubrication is achieved.

4) Since neither free CaO nor $3CaO.SiO_2$ is contained, granulation with water can be adopted.

5) All the components can be homogeneously distributed.

What is claimed is:

1. A mold additive suitable for use in a mold for continuous casting of steel characterized in that said mold additive consists essentially of, as its base material, at least 50% by weight of synthetic calcium silicate, 2 to 30% by weight of $SiO_2$ material, 3 to 30% by weight of flux material and 0.5 to 8% of carbonaceous material, said synthetic calcium silicate consisting of CaO and $SiO_2$ in a total amount not less than 70% by weight, $Al_2O_3$ in an amount not more than 8% by weight, $Fe_2O_3$ in an amount not more than 1% by weight and F in an amount of 2 to 7% by weight and whose $CaO/SiO_2$ ratio is not lower than 1.26.

* * * * *